United States Patent [19]

Lawrence

[11] 4,121,863

[45] Oct. 24, 1978

[54] LATCH ASSEMBLY

[75] Inventor: Dean M. Lawrence, Aurora, Ill.

[73] Assignee: Caterpillar Tractor Co., Peoria, Ill.

[21] Appl. No.: 851,008

[22] Filed: Nov. 14, 1977

[51] Int. Cl.[2] ..... E05C 9/04

[52] U.S. Cl. ..... 292/175; 292/150

[58] Field of Search ..... 292/153, 163, 145, 150, 292/152, 146, 175, DIG. 57

[56] References Cited

U.S. PATENT DOCUMENTS

| | | | |
|---|---|---|---|
| 504,262 | 8/1893 | Adams | 292/150 |
| 1,601,482 | 9/1926 | Sutherland | 292/145 |
| 2,098,569 | 11/1937 | Curtis | 292/150 X |
| 3,413,830 | 12/1968 | Rifkin | 292/150 X |
| 3,792,885 | 2/1974 | Giardina | 292/150 X |

FOREIGN PATENT DOCUMENTS

| | | | |
|---|---|---|---|
| 684,984 | 12/1952 | United Kingdom | 292/150 |

*Primary Examiner*—J. Franklin Foss

*Attorney, Agent, or Firm*—Wegner, Stellman, McCord, Wiles & Wood

[57] ABSTRACT

A latch mechanism having a latch member defining a slide portion received in a track channel. The slide portion is slidably guided by the track for movement between a latching position and a retracted position. A helical spring is provided for biasing the latch member to the latching position and a force transfer member is disposed between the end of the spring and the latch member slide portion in the channel for preventing catching of the spring end between the latch member and the track member in the channel.

10 Claims, 3 Drawing Figures

LATCH ASSEMBLY

BACKGROUND OF THE INVENTION

1. Field of the Invention

This invention relates to latch mechanisms and in particular to spring biased latch mechanisms.

2. Description of the Prior Art

In one form of vehicle construction, a cab is provided having a selectively positionable window. A latch mechanism is conventionally provided for holding the window in one or more preselected dispositions, such as in an open arrangement.

In one form of such latch mechanism, a latch member thereof is slidably guided in a track member and is biased to a latching position by a helical compression spring.

A problem has arisen in the latch mechanisms of this type in that it has been found that, from time to time, the end of the spring catches between the latch member and the track member in the slide channel, thereby causing a hangup of the latch mechanism.

This problem is aggravated by the normal vibrations occurring during use of such vehicles in causing the spring end to move about somewhat in the channel and, thus, tend, at times, to catch the latch member.

SUMMARY OF THE INVENTION

The present invention comprehends an improved latch mechanism having means for effectively preventing such catching of the latch member which is extremely simple and economical of construction while yet effectively positively avoiding the problem of the prior art as discussed above.

More specifically, the invention comprehends the provision of an improved latch mechanism having a force transfer member disposed between the spring end portion and the latch member slide portion in the guide channel.

In the illustrated embodiment, the force transfer member comprises a roller element, and more specifically, comprises a ball element.

The track member channel may define a portion of cylindrical configuration whereby the ball element may be fitted in the cylindrical portion to have free rolling movement therein.

In the illustrated embodiment, the latch member defines a pair of opposed slide portions received in a corresponding pair of slide channels and biased by a corresponding pair of cooperating helical compression springs and force transfer members.

In the illustrated embodiment, the latch mechanism is provided with a suitable retaining means permitting removal of the spring and force transfer member when desired. In the illustrated embodiment, the retaining means comprises removable shoulder means disposed at one end of the guide channel.

Thus, the latch mechanism of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
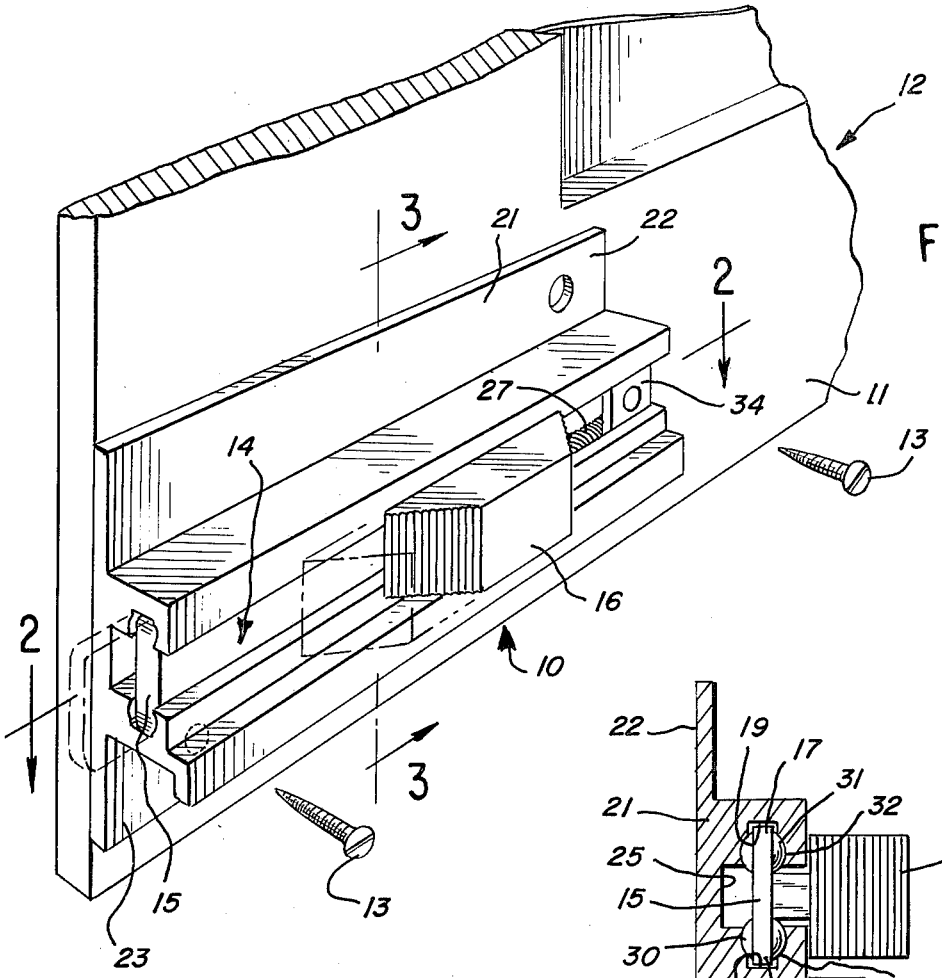
FIG. 1 is a fragmentary perspective view of a latch mechanism embodying the invention.

In the exemplary embodiment of the invention as disclosed in the drawing, a latch mechanism generally designated 10 is illustrated as being mounted on a frame portion 11 of a window 12. As shown, the latch mechanism may be secured to the frame by suitable removable securing means, such as screws 13.

Latch mechanism 10 includes a latch member generally designated 14 defining a slide portion 15 and a manipulating portion 16.

Figure 3:
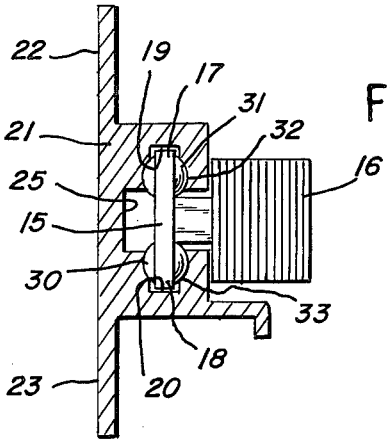
FIG. 3 is a vertical section taken substantially along the line 3—3 of FIG. 1.

Latch member slide portion 15 defines a pair of side edge portions 17 and 18 which, as shown in FIG. 3, are slidably received in a pair of opposed channels 19 and 20, respectively, of a track member 21. As shown in FIG. 1, track member 21 defines a pair of side flanges 22 and 23 arranged to cooperate with screws 13 in securing the latch mechanism to the frame 11.

Figure 2:
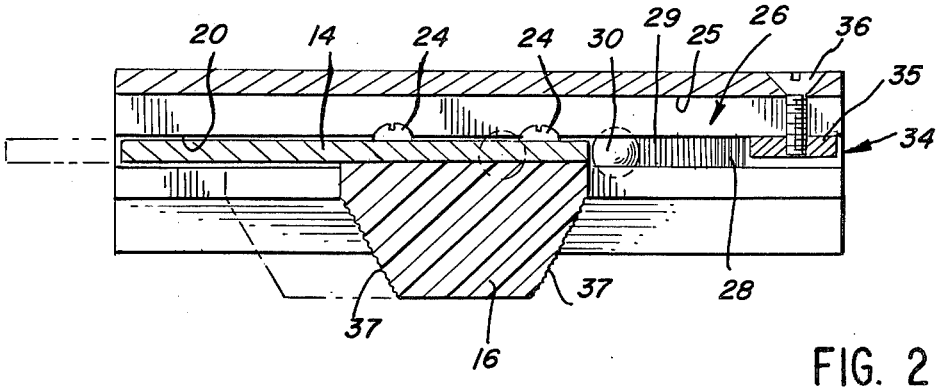
FIG. 2 is a section thereof taken substantially along the line 2—2 of FIG. 1.

Referring now more specifically to FIG. 2, manipulating portion 16 is secured to one end of the latch member 14 by suitable removable securing means, such as screws 24 projecting into a groove 25 in the track member intermediate the channels 19 and 20.

The latch member is biased to the left, as seen in FIGS. 1 and 2, to a latching position, as shown in broken lines therein, by a biasing means generally designated 26. The biasing means includes a pair of helical compression springs 27 and 28 received in channels 19 and 20, respectively.

As shown in FIG. 2, the end 29 of the spring 28 juxtaposed to the righthand end of latch member 14, abuts a force transfer member 30 received in the channel 20. As shown in FIGS. 1 and 3, a similar force transfer member 31 is disposed in channel 19, the force transfer member 31 being disposed between spring 27 and latch member 14.

As further shown, channel 19 defines a segmentally cylindrical portion 32 and channel member 20 defines a corresponding segmentally cylindrical portion 33. The force transfer members define roller elements, and more specifically, as shown in FIGS. 2 and 3, define ball roller elements complementary to and fitted in cylindrical portions 32 and 33 of the channels to have free rolling movement in the channels.

As further illustrated in FIGS. 1 and 2, the outer ends of the springs 27 and 28 abut a retaining element 34 having upper and bottom edge portions 35 received in channel portions 32 and 33, respectively, and secured to the track member by a suitable removable securing means, such as screw 36.

Thus, as illustrated in FIG. 2, the biasing springs are compressed between the retaining member 34 and the force transfer members, thereby urging the latch member 14 to the latching position shown in broken lines therein. The interposing of the force transfer members 30 and 31 between the spring ends and the track member effectively prevents catching of the spring ends between the latch member slide portion 15 and the track member 21 in the channels 19 and 20, respectively. Thus, the end 29 of the springs may be the full diameter of the coil spring permitting the springs to be of low cost by being cut to suitable lengths from conventional coil spring material. This avoids the costly operation of reducing the end of the coil spring as has been attempted as one solution to the problem of catching of the spring end heretofore.

In the illustrated embodiment, as shown in FIG. 2, the diameter of the force transfer roller may be larger than the crosssectional diameter of the spring.

The removable retainer means 34 permits facilitated servicing of the latch mechanism by permitting facilitated disassembly and assembly thereof when desired.

In the illustrated embodiment, the track member may be formed as an extrusion having a suitable cross section, as illustrated in FIG. 3 and formed of suitable rigid material, such as extruded metal.

The manipulating handle 16 may be formed of suitable material, such as molded synthetic resin, and may be provided with serrated surfaces 37 for facilitated fingertip manipulation.

The foregoing disclosure of specific embodiments is illustrative of the broad inventive concepts comprehended by the invention.

The embodiments of the invention in which an exclusive property or privilege is claimed are defined as follows:

1. In a latch mechanism having a latch member defining an edge slide portion, and a track member defining an open channel of substantially constant cross section slidably receiving said slide portion for guiding the latch member between a latching position and a retracted position, improved biasing means for biasing the latch member to the latching position comprising:

a helical compression spring having an end portion juxtaposed to said latch member slide portion in said channel; and a force transfer member disposed between the spring end portion and said latch member slide portion in said channel and defining means for preventing catching of said spring end portion between said latch member slide portion and said track member in said channel, said force transfer element being complementary to said channel to have a movable centered fit therein and said spring having a transverse section smaller than that of said channel, said force transfer element defining means for centering said spring end portion in the channel.

2. The latch mechanism of claim 1 wherein said force transfer member comprises a roller element.

3. The latch mechanism of claim 1 wherein said force transfer member comprises a ball element.

4. In a latch mechanism having a latch member defining a slide portion, and a track member defining a channel slidably receiving said slide portion for guiding the latch member between a latching position and a retracted position, improved biasing means for biasing the latch member to the latching position comprising:

a helical compression spring having an end portion juxtaposed to said latch member slide portion in said channel; and a force transfer member disposed between the spring end portion and said latch member slide portion in said channel and defining means for preventing catching of said spring end portion between said latch member slide portion and said track member in said channel, said slide portion of the latch member defining a pair of spaced parallel channels, said latch member slide portion defining a pair of edge portions slidably received one each in said channels, and said biasing means including a second helical compression spring having an end portion, the end portion of said first named spring being juxtaposed to one of said latch member edge portions in one of said channels and the end portion of said second spring being juxtaposed to the other of said latch member edge portions in the other of said channels, said biasing means further comprising a second force transfer member, said force transfer members jointly defining means for preventing catching of both said spring end portions between said latch slide portions and said track members in said channels.

5. The latch mechanism of claim 4 wherein said force transfer members comprise similar elements.

6. The latch mechanism of claim 4 wherein said force transfer members comprise roller elements.

7. The latch mechanism of claim 4 wherein said force transfer members comprise ball elements.

8. The latch mechanism of claim 4 wherein each channel defines a segmentally cylindrical portion and said force transfer members comprise ball elements fitted in said cylindrical portion of the channels to have free rolling movement therein.

9. The latch mechanism of claim 1 further including means at one end of said channel for removably retaining said spring and force transfer member against movement outwardly from said one end of said channel.

10. The latch mechanism of claim 4 wherein said force transfer member comprises a ball element having a diameter larger than the diameter of said helical spring.

* * * * *